United States Patent [19]

Sanford

[11] Patent Number: 4,967,477

[45] Date of Patent: Nov. 6, 1990

[54] CUTTING BLADE FOR MAKING DESIGNS IN FOOD PRODUCTS AND METHOD OF USE

[76] Inventor: Howard R. Sanford, 501 S 300 East, Springville, Utah 84663

[21] Appl. No.: 367,149

[22] Filed: Jun. 16, 1989

[51] Int. Cl.[5] ..... B26B 3/00; B26B 3/04; B27B 33/02

[52] U.S. Cl. ..... 30/315; 30/314; 83/847

[58] Field of Search ..... 30/303, 305, 314, 315, 30/308; 83/847, 846

[56] References Cited

U.S. PATENT DOCUMENTS

| | | | |
|---|---|---|---|
| 181,918 | 9/1876 | Cushing | 30/315 |
| 566,865 | 9/1896 | Morrish | 83/846 |
| 817,361 | 4/1906 | Brown et al. | 83/847 |
| 2,086,620 | 7/1937 | Hoffman | 30/315 |
| 2,309,814 | 2/1943 | Youngberg | 30/315 |
| 4,327,489 | 5/1987 | Conrad | 30/315 |
| 4,457,070 | 7/1984 | Reeves | 30/314 |
| 4,792,299 | 12/1988 | McCaffrey | 30/315 |

*Primary Examiner*—Douglas D. Watts
*Assistant Examiner*—Paul M. Heyrana, Sr.

[57] ABSTRACT

A new type of cutting blade with handle for making designs in food products, such as hot dogs, to facilitate the addition of other materials to the food product, and to facilitate cooking and decoration, comprising an elongated thin metal blade with handle, said blade having a top and bottom edge and cutting width, and said blade being bent in a plurality of alternate directions so as to form an unique design on cutting, the bottom edge of the blade having a cutting edge with a plurality of indentations which prevent the blade from forming a complete cut along the bottom edge of the blade, and a method for using the new blade to form unique designs along food material, such as hot dogs, and facilitate the addition of other material thereto.

7 Claims, 4 Drawing Sheets

CUTTING BLADE FOR MAKING DESIGNS IN FOOD PRODUCTS AND METHOD OF USE

BACKGROUND OF THE INVENTION

1. Field of the Invention

This invention relates to a new type of cutting blade for making designs in food products, and to a method for using the same.

Specifically, the invention provides a new type of cutting blade for making designs in food products, such as hot dogs, to facilitate the cooking and decoration of said food and facilitate the incorporation of other materials with the food. The new cutting blades broadly comprise an elongated thin metal or other rigid material blade with a handle, said blade having a top and bottom edge and width of cutting size, and said blade being bent in a plurality of alternating directions so as to form an unique design on cutting the desired food product, the bottom cutting edge of the blade having a plurality of indentations which prevent the blade from forming a complete cut out of the bottom surface when pressed through the desired food material.

The invention further provides a method for using the new cutting blades which comprises pressing the new blade down lengthwise along the desired food product so as to cut the desired design in the top of the food product without cutting completely through the product, and then preferably heating the cut product, preferably in a microwave oven, to effect an opening of the seam cut along the top of the food product, and thus provide an opening for the addition of other components, such as in the case of hot dogs, with the addition of condiments, such as relish, mustard, catsup, and the like.

2. Prior Art

Many food products, such as hot dogs, are served in combination with other materials, such as relish, mustard, hot dogs, catsup, and the like. This is generally accomplished by placing the hot dog in a bun that has been slit open, and then adding additional condiment ingredients along the top of the hot dog. When the bun is closed down on the hot dog, much of the material added is pushed out and the bun becomes difficult to handle. In addition, much of the added ingredients only come in contact with the outside of the bun and this limits the enjoyment of the added components in combination with the hot dog. Furthermore, in many cases the hot dog is oily and slick after being heated and pressure on the bun often forces the hot dog to slide out of the bun causing additional difficulty to reassemble the components.

It is an object of the invention, therefore, to provide a new type of cutting blade for making designs on food products. It is a further object to provide cutting blade that makes designs on food products which facilitates the addition of added ingredients to the said products. It is a further object to provide a new type of cutting blade for making designs in food products which facilitates the opening up of the food during the cooking of the product. It is an object to provide a new type of cutting blade that makes designs in food products which facilitates decoration of the product. It is a further object to provide a process for creating designs in food products which facilitates the addition of other components and the resulting use of the combination. These and other objects of the invention will be apparent from the detailed description thereof.

SUMMARY OF THE INVENTION

It has now been discovered that these and other objects can be accomplished by the new cutting blade of the present invention which broadly comprises an elongated thin rigid material with handle, said blade having a top and bottom edge and width of cutting size, and said blade being formed in a plurality of alternating directions so as to form an unique design on cutting the desired good product, the bottom cutting edge of the blade having a plurality of indentations which prevent the blade from forming a complete cut out of the bottom surface when pressed through the desired good material.

The new cutting blades are preferably used by pressing the blade lengthwise along the top of the food product and pressing down firmly so that it preferably cuts substantially all the way through the food material, the indentations in the cutting edge preventing the blade from making a complete cut out of the bottom of the material. The cut food material is then preferably placed and heated in a microwave oven to effect an opening of the same cut along the top of the food product. The opening so created presents many surprising advantages. For example, the opening forms a very attractive design on the top of the food material and makes the material more interesting and decorative. In addition, the opening provides a convenient place for the addition of other ingredients such as condiments as mustard, relish, catsup, and permits then to be retained within the opening even when pressure is applied to the top of the food product. The use of the new cutting blades is particularly suited for use for application to hot dogs and related food products. For example, when one presses down the blade along the top and length of the hot dog, a creative design is produced on the said top. When the cut hot dog is then placed in a microwave oven, the design opens up into a very attractive opening in which the desired condiments, such as relish, mustard, etc. can be placed. When a hot dog so treated and the condiments applied is then placed in a bun and the top pressed down, the ingredients are readily retained in the bun as well as penetrating down through the hot dog itself. Further advantage is found in the fact that the hot dog so treated is readily retain in the bun even though pressure is applied to the top of the bun and there is little danger of the hot dog slipping out of the bun.

DESCRIPTION OF THE DRAWINGS

The various objects and features of the present invention will be more fully understood by reference to the accompanying drawings.

With reference to FIG. 1, the new cutting blade of the present invention is shown as 11, the bent blade portion as 12, the top edge of the blade portion as 12A, the one side of the blade as 12B and the bottom cutting edge as 12C. The indentations on the bottom cutting edge are shown as 14, and the handle for the cutting blade is shown as 13.

With reference to FIG. 2 which is a top view of the cutting blade, the bent cutting blade portion is shown as 12, the top edge of the blade as 12A and the side of the blade as 12B. The top of the handle is shown as 13A.

With reference to FIG. 3 which illustrates a new cutting blade assembly where the handle is at the top, the cutting blade portion is shown as 12, the top of the blade as 12A, the side of the blade as 12B and the bottom cutting edge as 12C. The handle attached to the top of the blade is shown as 16. The stationary posts to hold the cutting blade as it is raised and lowered is shown as 15. The grooves where the blade is held and allows the blade to be raised and lowered is shown as 17.

With reference to FIG. 4 which is a top view of a hot dog which has been cut by the new cutting blade, the hot dog is illustrated as 19 and the cut on the top of the hot dog made by the cutting blade is shown as 20.

With reference to FIG. 4A which is a side view of the hot dog cut as in FIG. 4, the hot dog is shown as 19, the dotted line within the hot dog represents the depth of the cut made in the hot dog, with 20A showing the side and 20B the bottom of the cut which leaves still some uncut hot dog because of the indentations in the cutting blade.

With reference to FIG. 5 which is an illustration of the opening made by the cutting seam after the cut hot dog has been heated in the microwave oven for a few seconds.

In FIG. 6 which is a top view of the hot dog showing a different design made by a modified cutting blade which forms such a seam, the hot dog is shown as 19 and the new design at the top of the hot dog as 22.

In FIG. 7 which is a top view of the hot dog showing another different complicated design representing flowers, the hot dog is shown as 19 and the new design made by a modified cutting is shown as 23.

In FIG. 8 which is a top view of the hot dog showing another different and complicated Egyptian design, the hot dog is shown as 19 and the new design made by a modified cutting blade as 24.

In FIG. 9 which is a top view of the hot dog showing another different complicated design, the hot dog is shown as 19 and the new design as 25.

DETAILED DESCRIPTION OF THE INVENTION

While the above-described description of the invention and the drawings have been made in rather specific terms, it should be understood that various changes can be made in construction and design and operation without departing from the scope of the present invention.

The cutting blade can be of any shape and size as long as it accomplishes the above-noted purpose of forming a design in the top of the food material. With smaller objects, such as hot dogs, the cutting blade can be of sufficient length and width to cut through the food material. The depth of cutting can vary as desired but in most cases it is preferred to cut almost completely through the food material with the indentations on the cutting edge being such as to prevent the cut from cutting the food material completely in half. With material, such as hot dogs, the width of the blade should preferably vary from about ½ to 3 inches with the length being about 6 to 8 inches, again depending on the nature of the food material to be cut.

The thickness of the blade itself may also vary depending on the type of food material to be cut. For soft products, such as hot dogs the blade can be relatively thin, say from about 1/32 to 1/16 inches in thickness.

Figure 1:
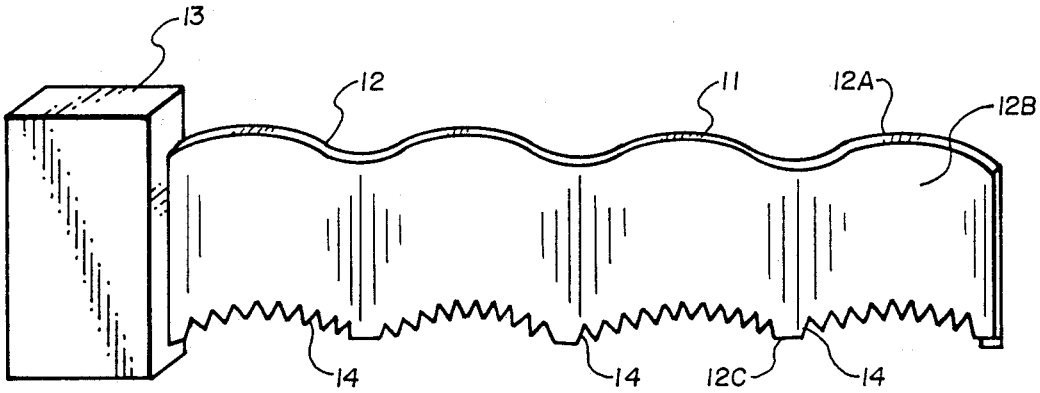
FIG. 1 is a front view of an example of the cutting blade of the present invention.
Figure 2:
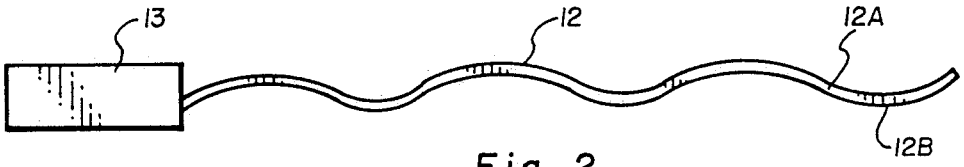
FIG. 2 is a top view of the cutting blade shown in FIG. 1.
Figure 7:
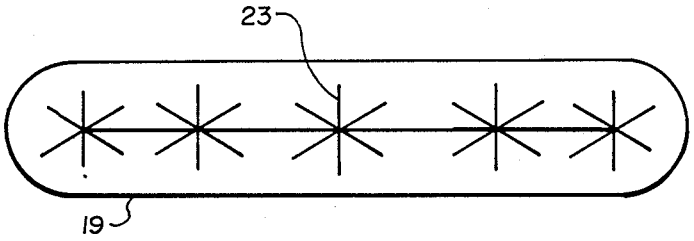

The blade can be made of any thin rigid material which permits the formation of a fine cutting edge on the bottom edge. The blade should also be made of material that can be easily formed into the desired design. The preferred material include various metals, such as steel, which can be easily formed into the curved designs, such as shown in FIG. 1. The designs can be made by bending the material in the right shape, but with complicated designs as shown in FIG. 7, it may be necessary to form the blade by joining the side pieces to the main blade as by soldering.

Figure 8:
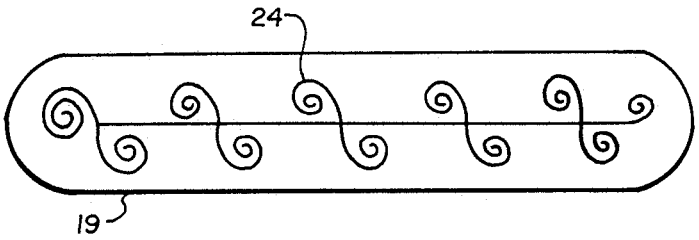
Figure 9:
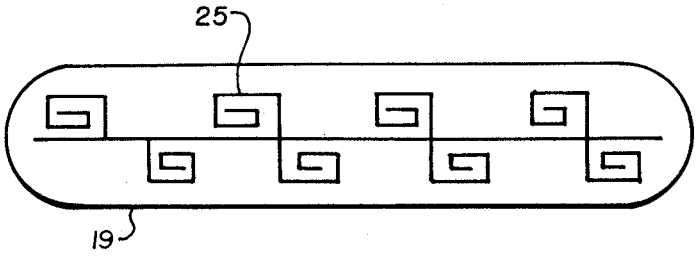
Figure 10:
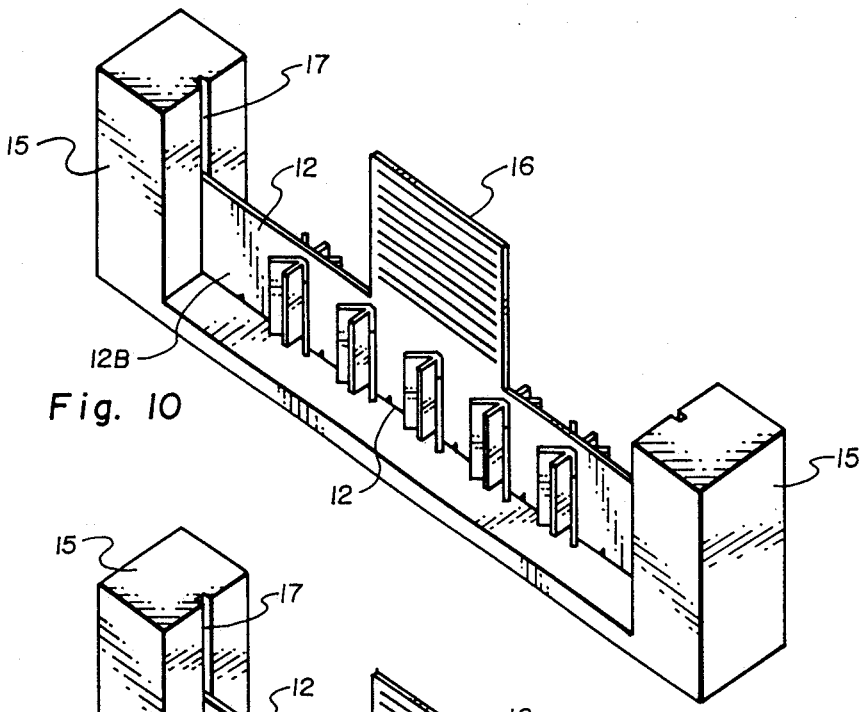
FIG. 10 represents the blade used to cut FIG. 7.
Figure 11:
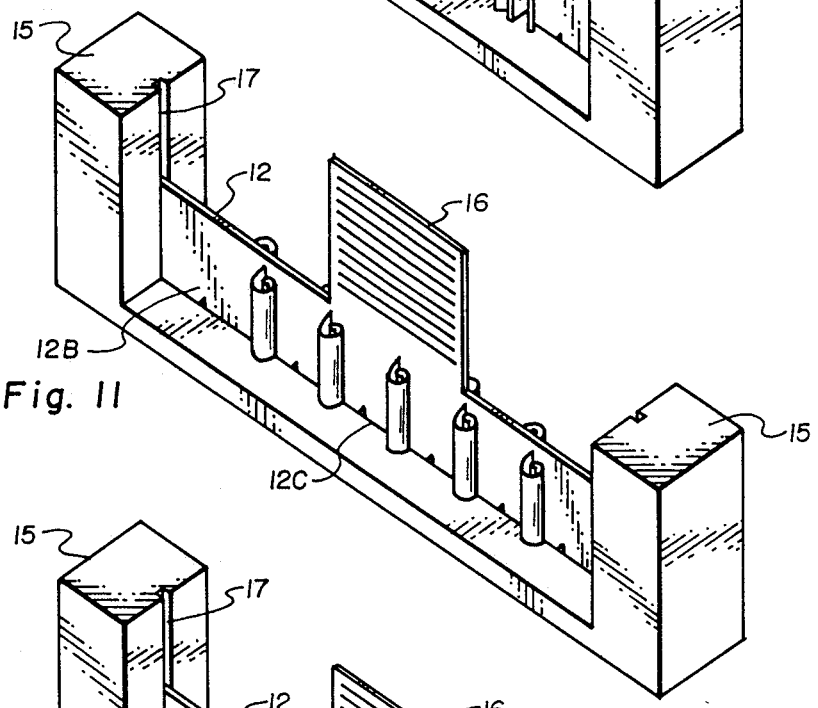
FIG. 11 represents the blade to cut FIG. 8.
Figure 12:
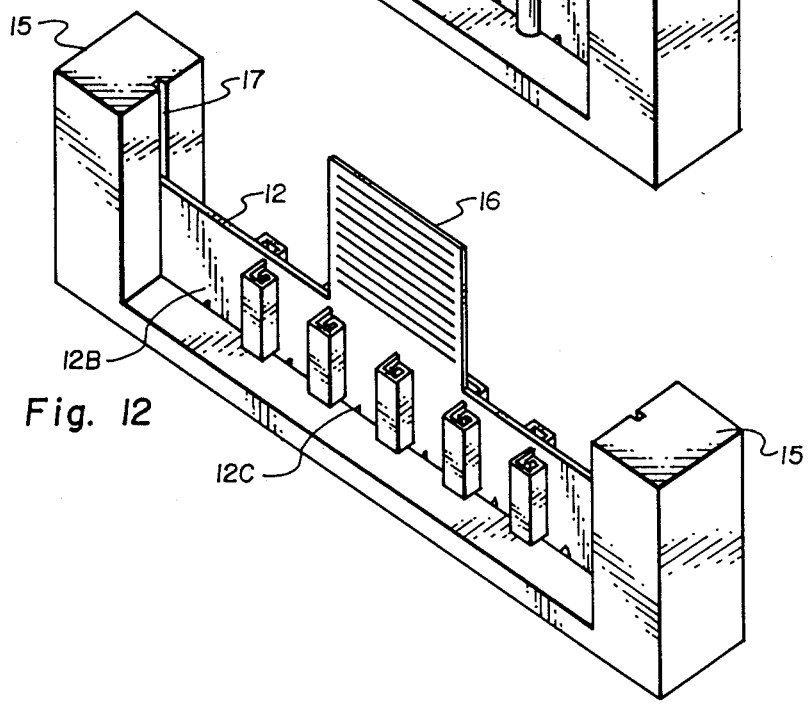
FIG. 12 represents the blade used to cut the design shown in FIG. 9. The numbered items in these figures. are as in FIG. 3.

As indicated, the blade portion is bent to form the desired design to be cut into the food product. As noted, the blade is bent in a plurality of alternating directions so as to form the desired design. Specifically, the blade portion is bent in a series of repeated cyma reversa and cyma recta patterns of equal width to length relationship, or any combination of straight or curved lines that creates an angle or pattern in a left to right direction. Preferable the blade is bent in the form of a sine curve, jagged straight or curved lines, a series of flower or animal curved designs and well known Egyptian type curves and symbols. Examples of some of such designs are shown in FIGS. 7, 8 and 9.

The bottom edge of the cutting blade is sharpened so as to easily facilitate the cutting into the top of the food material. The bottom edge is also modified so as to provide a plurality of indentations which keeps the cutting edge from cutting through the entire food material. The indentations provide a series of sections of the bottom of the food material which retain the entire material together. The indentations may vary in size as needed, but generally vary in depths of about ¼ to ½ inches and separated from each other generally from about ¼ to about 1 inch. The number of such indentations generally vary from about 10 to about 25 for the usually sized cutting blade adapted for cutting designs in material, such as hot dogs.

Figure 3:
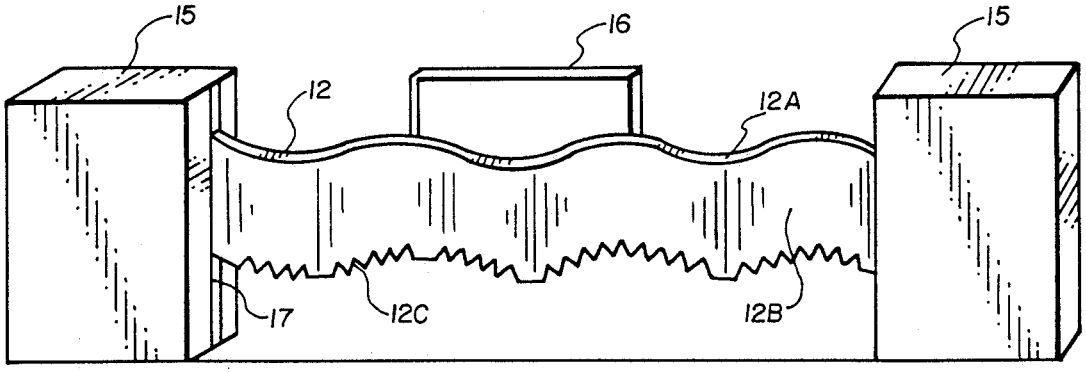
FIG. 3 is a front view of an example of the cutting blade of the present invention wherein the handle is at the top of the blade rather than at the side as in FIG. 1.
Figure 4:
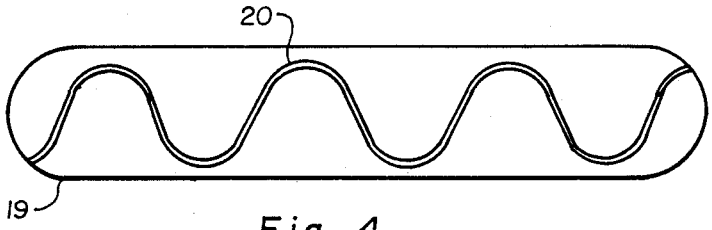
FIG. 4 is a top view of a hot dog showing the design that could be cut in the top of the hot dog by use of the cutting blade.
Figure 4A:
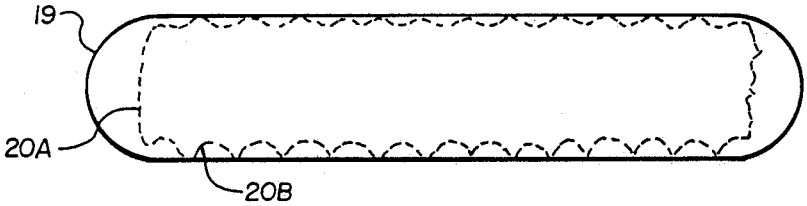
FIG. 4A is a side view of the hot dog which has been cut as shown in FIG. 4 showing the depth of the cut.

A handle is provided on the cutting blade to facilitate the pressing of the design on the food material. The handle may be attached to one or more of the sides as shown in FIG. 1 or it may be attached to the top of the blade as shown in FIG. 3. To facilitate the use of the cutting blade, the ends of the blade may also be guided into slots as shown in FIG. 3.

The handle can be constructed of any desired material and of any suitable size. In general, the handle is prepared from plastic, wood or metal and is of sufficient size to permit one to hold the cutting blade in a safe position and press the blade firmly into the top of the food material.

The new cutting blade of the present invention can be used to cut designs into any suitable food material, such as hot dogs, sausages, carrots, and the like. The blades are particularly suited for use in the forming of designs on hot dogs as noted hereinabove.

PREFERRED EMBODIMENT OF THE INVENTION

A preferred embodiment of the invention is described below. It should be understood, however, that this is given as a sample and preferred assembly only and is not to be regarded as limiting the invention in any way.

A handle held cutting blade was prepared by selecting a piece of flexible steel sheeting 1/32 inch thickness with a length of six inches and a width of 3 inches. The bottom edge was modified so as to form a ½ inch V shaped indentation every ½ inch. The bottom of the remaining portions of the edge was sharpened so as to provide a sharp cutting edge.

The cutting blade so produced was then bent into the design as shown in FIG. 1 by bending the blade over a round ¾ inch pole and then reversing the blade and bending the next section over the same pole to give a sine curve effect to the blade.

A handle was then prepared from ¾ inch oak wood with dimensions 2×3 inches with a slot in one side in which the blade is inserted. The blade is glued into the handle by means of epoxy resin glue, or attached with metal rivets.

Figure 5:
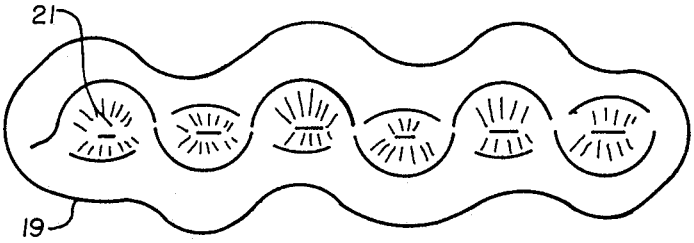
FIG. 5 is a top view of the hot dog cut as in FIG. 4 after it has been placed in a microwave oven and the design opened up by the heat.
Figure 6:
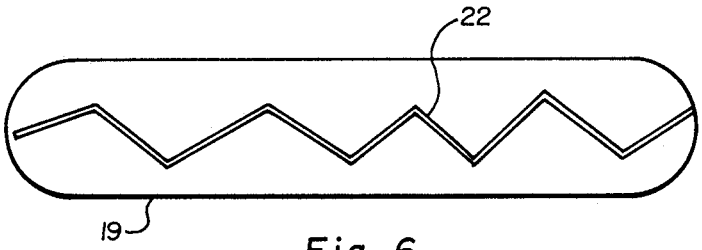
FIGS. 6 to 9 are top views of hot dogs showing various types of designs that can be cut in the hot dog by the use of the cutting blade of the present invention.

The above prepared hand held cutting blade was used to cut a sine curve design in the top of a series of hot dogs. The design was made by pressing the blade down through the hot dog but not effecting a complete cut out of the bottom of the hot dog. The resulting product was then placed in a microwave oven for 10 or less seconds and then removed. The design had opened up as shown in FIG. 5 providing a unique place for the placing of the mustard and other condiments. When placed in a bun there was no dripping or removing of the condiments and the hot dog did not slip out of the bun when pressure was placed thereon.

While the above-noted invention is directed to the forming of designs in food material by use of a hand held cutting blade, the same can be accomplished by mechanized means of using a needle or other sharp object to effect the design as the food material passes under such equipment as on a conveyor belt.

I claim as my invention

1. A hand held cutting blade for effecting designs on the top of food material which comprises an elongated thin rigid material blade with handle, said blade having a top and bottom edge and width of cutting size, and said blade being bent in a plurality of alternating directions so as to form an unique design on cutting the food material, the bottom cutting edge of the blade having a plurality of indentations which prevent the blade from forming a complete cut out of the bottom of the food material when the blade is pressed thereon.

2. A hand held cutting blade as in claim 1 wherein the blade is bent into a series of sine curves.

3. A hand held cutting blade as in claim 1 wherein the blade is bent into a series of repeated cyma reversa and cyma recta patterns of equal width to length relationship.

4. A hand held cutting blade as in claim 1 wherein the blade is bent to form a plurality of straight lines form a series of V shaped sections.

5. A process for using the hand held cutting blade as defined in claim 1 which comprises pressing the blade down on the top of a food material to effect a significant cut in the said material, and then withdrawing the blade and leaving the open design on top of the said material.

6. A process as in claim 5 wherein the food material is a hot dog.

7. A process as in claim 5 wherein the material with the design cut thereon is placed in a microwave oven for a short period to expand the design into an open section on top of the food material.

* * * * *